US006458038B1

(12) United States Patent
Lin

(10) Patent No.: US 6,458,038 B1
(45) Date of Patent: Oct. 1, 2002

(54) GOLF PUTTING INDICATION DEVICE

(76) Inventor: Teh-Cheng Lin, 752 Pradera Way, San Ramon, CA (US) 94583

( * ) Notice: Subject to any disclaimer, the term of this patent is extended or adjusted under 35 U.S.C. 154(b) by 0 days.

(21) Appl. No.: 09/945,410

(22) Filed: Sep. 4, 2001

(51) Int. Cl.[7] ..... A63B 69/36
(52) U.S. Cl. ..... 473/220; 473/151; 362/259
(58) Field of Search ..... 473/220, 221, 473/222, 223, 151, 183, 154, 155; 362/259; 273/127 C

(56) References Cited

U.S. PATENT DOCUMENTS 3,194,563 A * 7/1965 Mackniesh
4,341,384 A 7/1982 Thackrey ..... 273/186 A
4,708,343 A * 11/1987 D'Ambrosio
5,161,802 A * 11/1992 Daechsel
5,174,574 A 12/1992 Knox et al. ..... 273/179 B
5,330,188 A 7/1994 Reimers ..... 273/186.1
5,435,562 A * 7/1995 Stock et al.
5,464,222 A * 11/1995 Carney
5,465,972 A * 11/1995 Cornett
5,692,966 A * 12/1997 Wash
5,733,202 A * 3/1998 Vargo
5,873,789 A * 2/1999 Torriano
5,980,393 A 11/1999 Molinaroli et al. ..... 473/220

* cited by examiner

*Primary Examiner*—Paul T. Sewell
*Assistant Examiner*—Nini F. Legesse
(74) *Attorney, Agent, or Firm*—Donald J. Ersler

(57) ABSTRACT

A golf putting indication device includes a light emitting golf putter, a light sensing unit, and a display unit. The light emitting golf putter includes a light beam which projects from a strike face of the light emitting golf putter. The light sensing unit includes a plurality of photocells. Each photocell is housed in a tubular compartment. The display unit contains a plurality of light emitting devices. The number of light emitting devices corresponds to the number of photocells. Each photocell is electrically connected to a battery and to a single light emitting device. When a photocell is struck with the beam of light, the photocell's respective light emitting device emits light. In use, a golfer practices swinging the light emitting golf putter such that the light beam only enters one of the tubular compartments.

19 Claims, 10 Drawing Sheets

GOLF PUTTING INDICATION DEVICE

BACKGROUND OF THE INVENTION

1. Field of the Invention

The present invention relates generally to golf putters and more specifically to a golf putting indication device which allows a golfer to improve the accuracy of their putting swing.

2. Discussion of the Prior Art

There are several devices in the prior art which help a golfer orient a putter face for striking a golf ball. U.S. Pat. No. 4,341,384 to Thackrey discloses a golf swing diagnostic apparatus. U.S. Pat. No. 5,174,574 to Knox et al. discloses a putting target. U.S. Pat. No. 5,330,188 to Reimers discloses a putter alignment system. U.S. Pat. No. 5,980,393 to Molinaroi et al. discloses a golf club with laser system. However, none of these devices disclose a golf putting indication device which allows the golfer to practice swinging into a photocell.

Accordingly, there is a clearly felt need in the art for a golf putting indication device which allows golfers of varying skill level to practice their golf putting swing.

SUMMARY OF THE INVENTION

The present invention provides a golf putting indication device which allows a golfer to improve their golf putting swing. The golf putting indication device includes a light emitting golf putter, a light sensing unit, and a display unit. The light emitting golf putter includes a light projecting device, at least one battery, and an on-off switch. The light projecting device is disposed in a putter head of the golf putter. The light beam of the light projecting device projects out of the putter head substantially perpendicular to a strike face of the putter head. The on-off switch is preferably disposed on a shaft of the golf putter below a handle.

The light sensing unit includes a power source, a photocell board, a photocell housing, a sense housing, and an on-off switch. The photocell housing preferably includes at least three tubular compartments disposed adjacent to each other. Preferably, the photocell housing includes three rows and five columns of tubular compartments. Preferably, the three rows of tubular compartments are identical in height. Preferably, six outside tubular compartments are identical in width and six inside tubular compartments are also identical in width. The tubular compartments prevent photocells from being falsely triggered by sunlight. The power source is preferably at least one battery. The at least one battery powers the photocells and the on-off switch controls electrical power supplied to the photocells. The at least one battery, photocell board, photocell housing and on-off switch are retained in the sense housing.

The display unit contains a plurality of light emitting devices. The number of light emitting devices corresponds to the number of photocells. Each photocell is electrically connected to the battery and to a single light emitting device. When one of the photocells is struck with a beam of light, the photocell's respective light emitting device emits light.

The golf putting indication device is preferably used in the following manner. The on-off switches on the light emitting golf putter and the light sensing unit are turned on. The golfer aims the light beam projecting out of the strike face at one of the tubular compartments. The golfer practices swinging the light emitting golf putter such that the light beam only enters one of the tubular compartments. The golfer knows which tubular compartment is struck because its respective light emitting device emits light. If a light emitting device from another column of tubular compartments emits light during the swing, the golfer knows that their swing was not straight.

These and additional objects, advantages, features and benefits of the present invention will become apparent from the following specification.

DETAILED DESCRIPTION OF THE PREFERRED EMBODIMENTS

Figure 1:
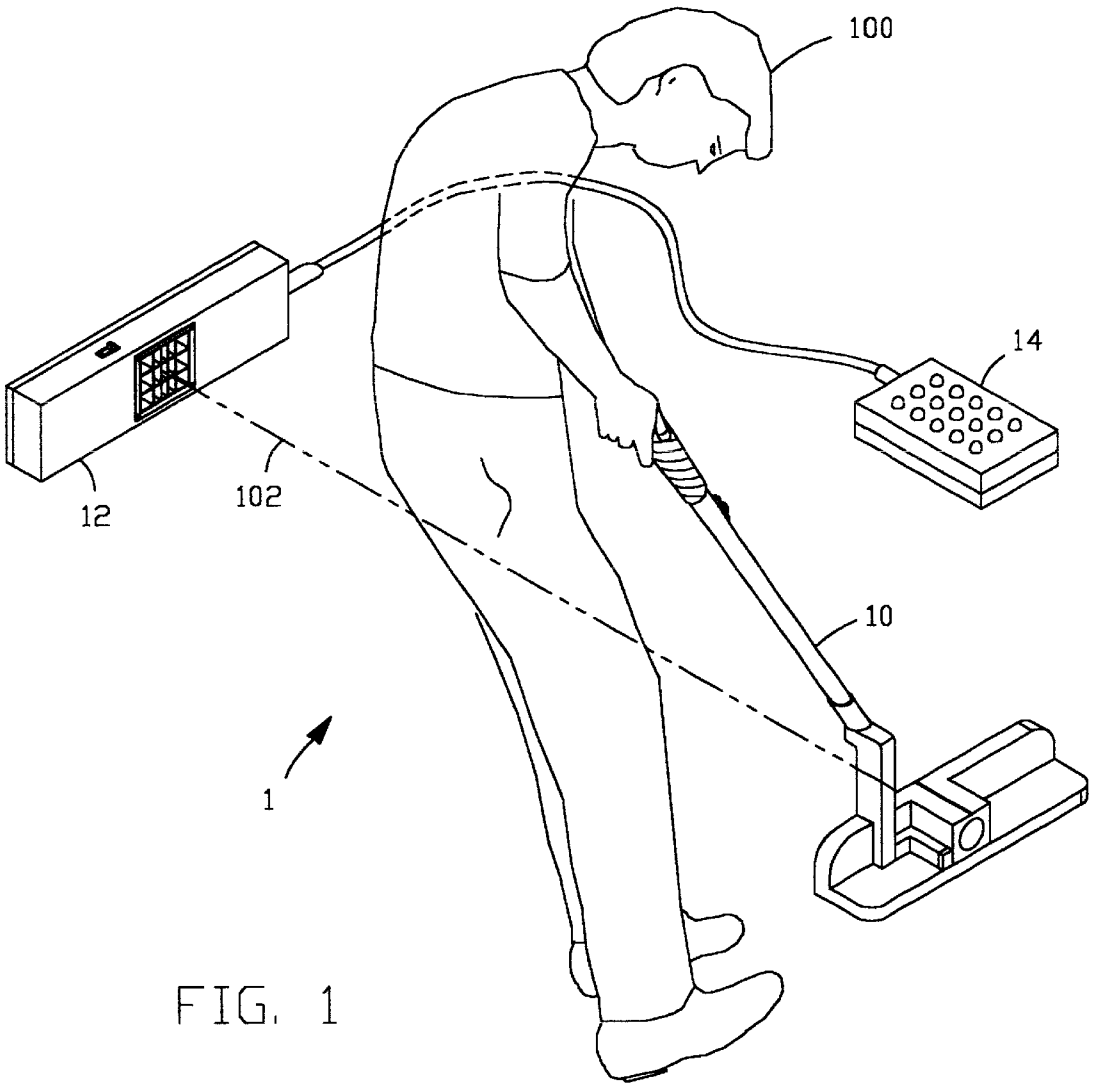
FIG. 1 is a perspective view of a golfer utilizing a golf putting indication device in accordance with the present invention.
Figure 2:
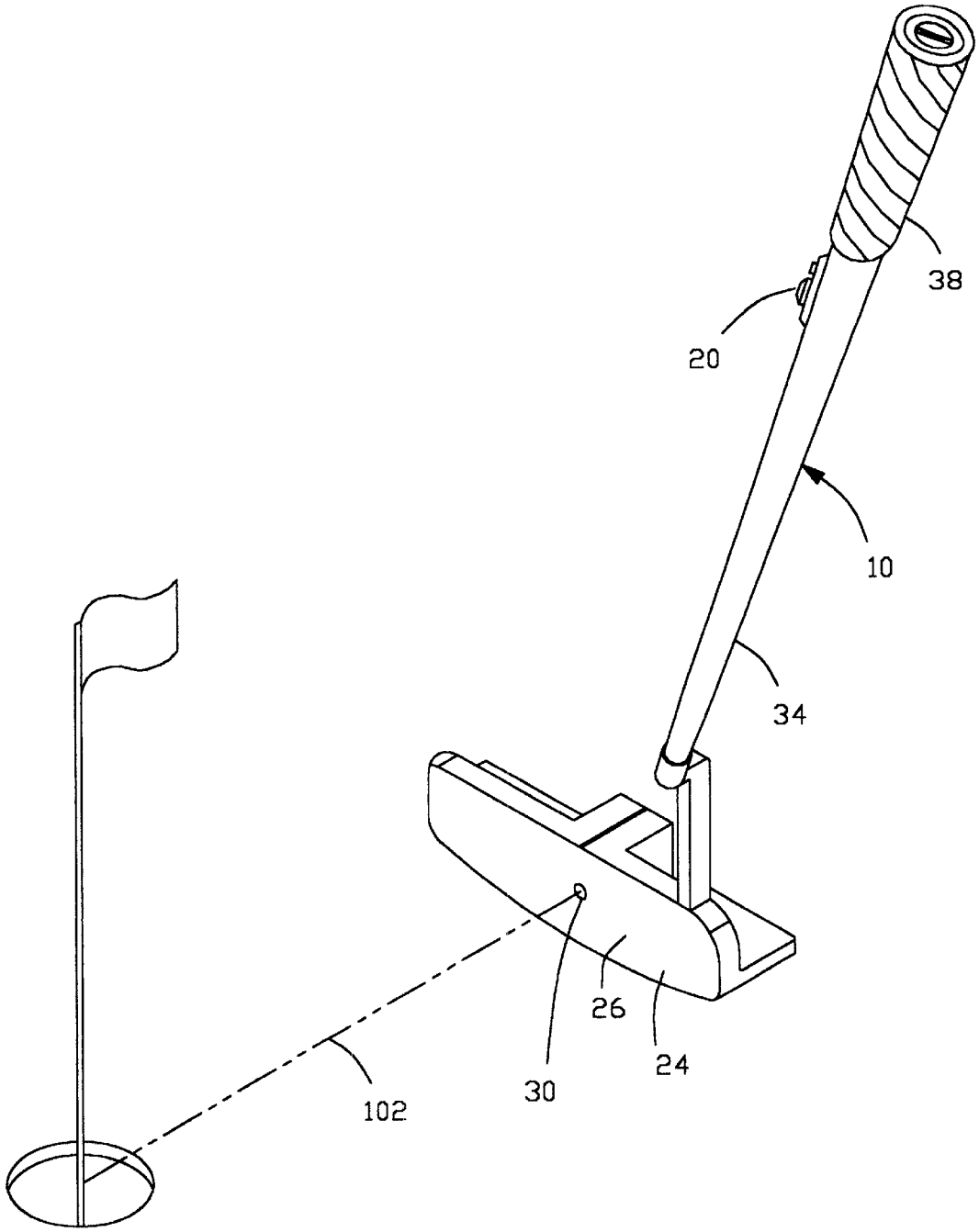
FIG. 2 is a perspective view of a light emitting golf putter of a golf putting indication device in accordance with the present invention.
Figure 3:
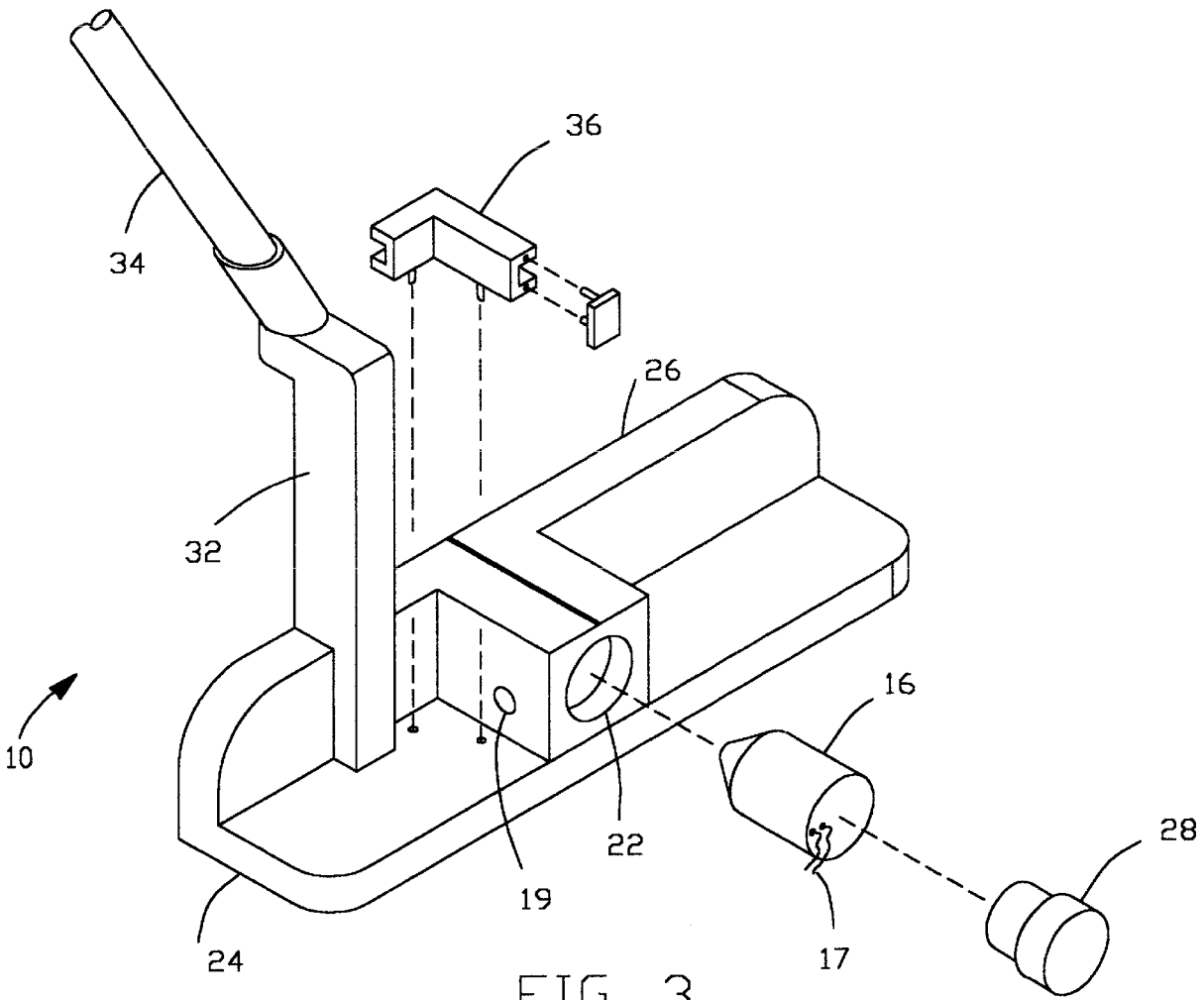
FIG. 3 is an exploded perspective view of a putter head of a light emitting golf putter in accordance with the present invention.
Figure 4:
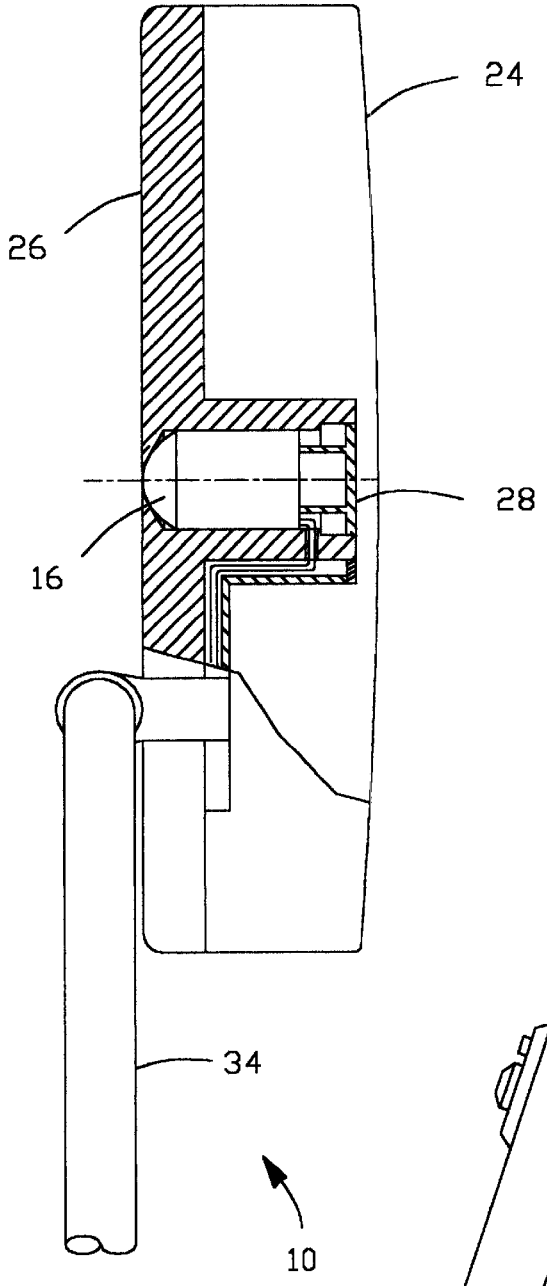
FIG. 4 is a top cross sectional view of a putter head of a light emitting golf putter in accordance with the present invention.
Figure 5:
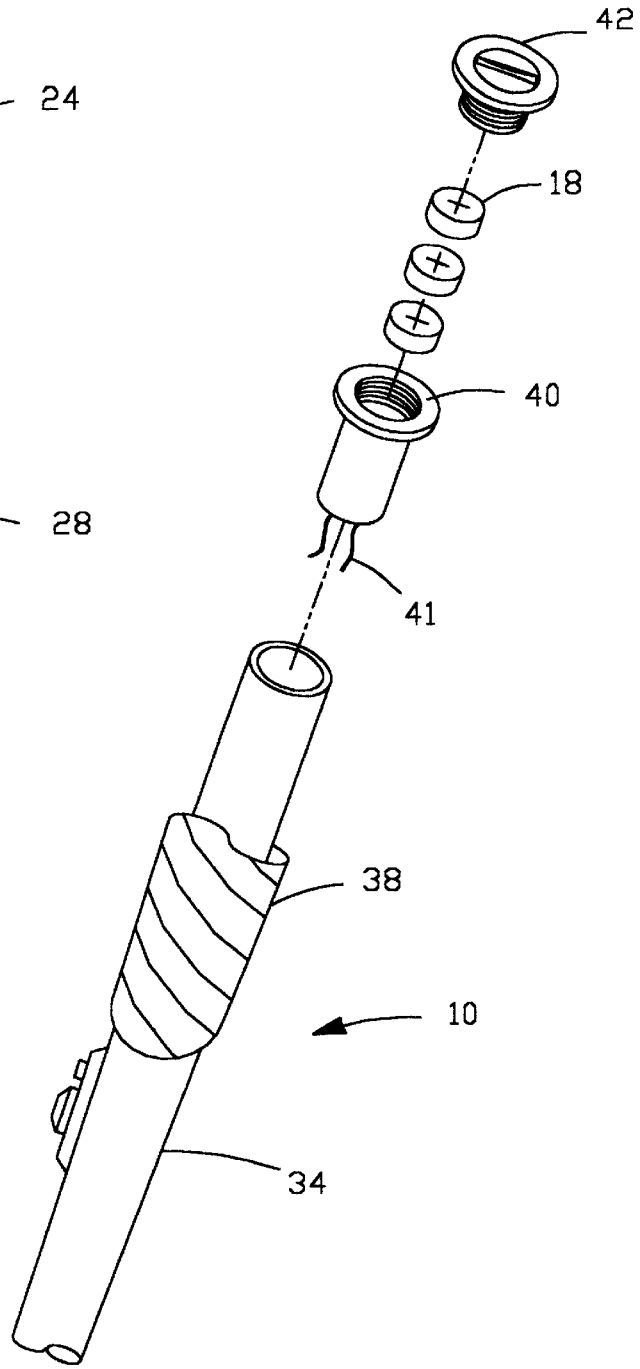
FIG. 5 is a partially exploded perspective view of a shaft of a light emitting golf putter in accordance with the present invention.
Figure 6:
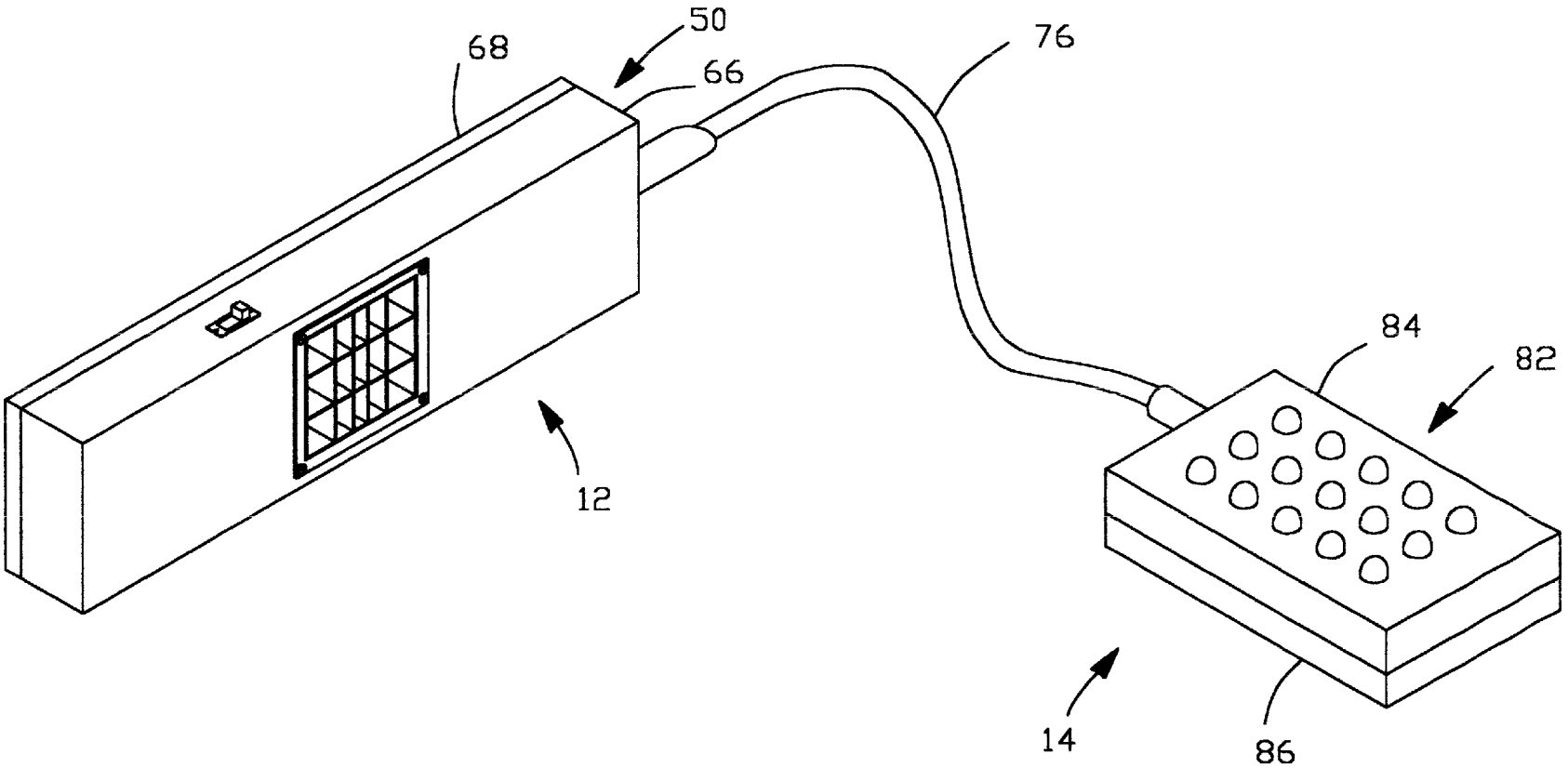
FIG. 6 is a perspective view of a light sensing unit and a display unit of a golf putting indication device in accordance with the present invention.

With reference now to the drawings, and particularly to FIG. 1, there is shown a perspective view of a golfer 100 utilizing a golf putting indication device 1. The golf putting indication device 1 includes a light emitting golf putter 10, a light sensing unit 12, and a display unit 14. With reference to FIGS. 2–5, the light emitting golf putter 10 includes a light projecting device 16, at least one battery 18, and an on-off switch 20. Preferably, a bore 22 is formed in a putter head 24 opposite a strike face 26. The light projecting device 16 is inserted into the bore 22 and preferably retained in the bore 22 with a plug 28. Other devices or methods may be used to retain the light projecting device 16 in the bore 22. The light emitting device 16 is preferably a laser pointer, but other light projecting devices may also be used.

A light beam 102 of the light projecting device 16 projects through a light opening 30 formed through the strike face 26. The light beam 102 from the light projecting device 16 is substantially perpendicular to the strike face 26. Wires 17 of the light projecting device 16 are preferably routed through a hole 19 in the putter head 24 to a hole (not shown) in a shaft receiver 32 through the inside diameter of a shaft 34. A wire cover 36 is attached to the putter head 24 adjacent the hole 19 in the putter head 24 and the hole in the shaft receiver 32. The wire cover 36 protects the exposed wires 17 from damage.

Figure 13:
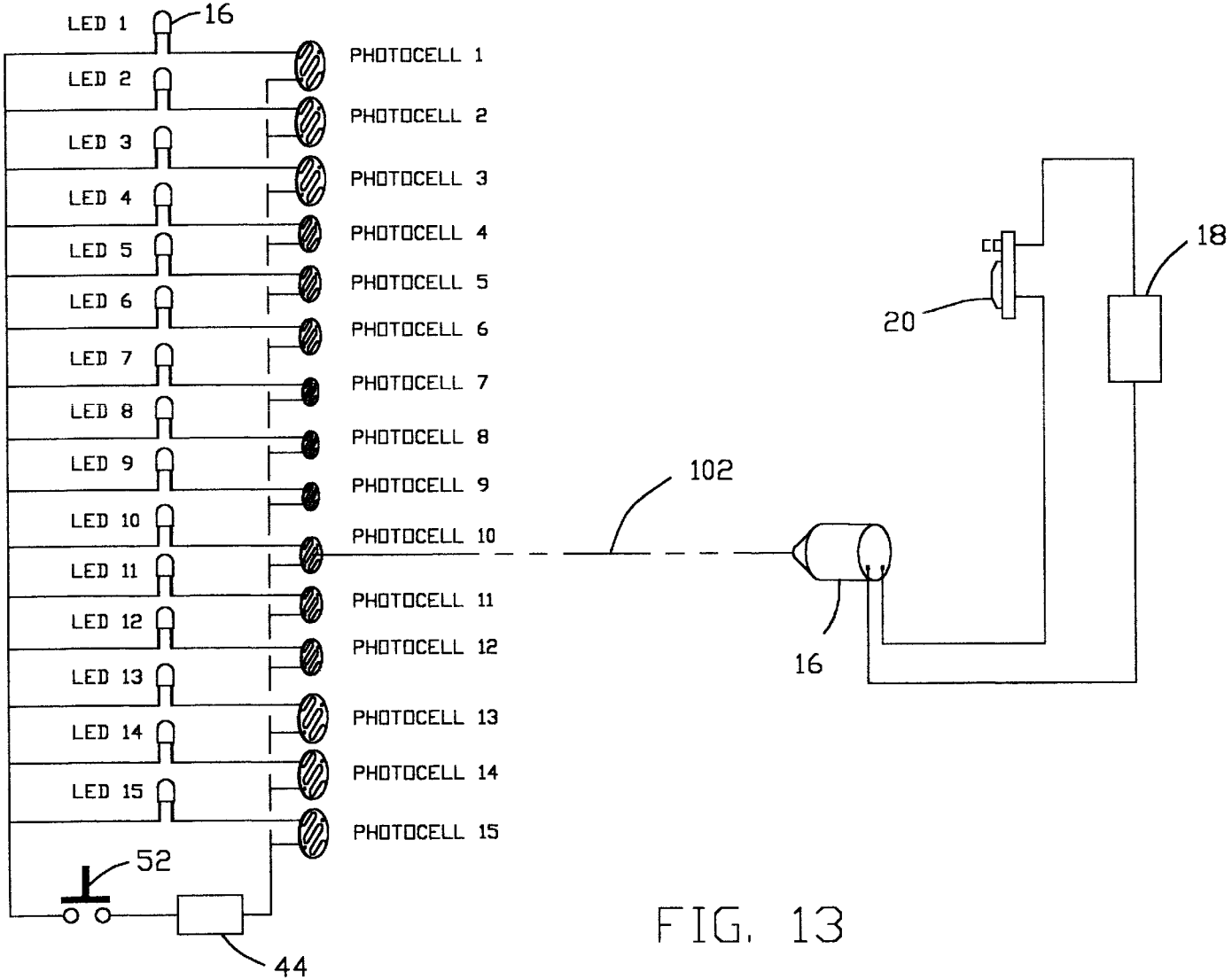
FIG. 13 is an electrical schematic diagram of the golf putting indication device in accordance with the present invention.

The on-off switch 20 is preferably attached to the shaft 34 below a handle 38. A battery holder 40 is preferably inserted into an end of the shaft 34. Battery holders are well known in the art and need not be described in detail. The at least one battery 18 is preferably retained in the battery holder 40 with a retention cap 42. The retention cap 42 is shown as threading into the battery holder 40 in FIG. 5, but other methods of securing a retention cap to the battery holder 40 may also be used. Battery holder wires 41 extend from a bottom of the battery holder 40. The holder wires 41 are connected to the on-off switch 20 and the light projecting device 16. The on-off switch 20 is preferably a 3-way type with a lock in the "on" position, but other types of on-off switches may also be used. With reference to FIG. 13, an electrical schematic of the light emitting golf putter 10 is shown.

With reference to FIGS. 6–10, the light sensing unit 12 includes a power source, a photocell board 46, a photocell housing 48, a sense housing 50, and an on-off switch 52. The photocell housing 48 preferably includes at least three tubular compartments disposed adjacent to each other, but may only include a single tubular compartment. Preferably, the photocell housing 48 includes three rows and five columns of tubular compartments. Preferably, the three rows of tubular compartments are identical in height.

Preferably, six outside tubular compartments 54 are identical in width; six inside tubular compartments 56 are identical in width; and three center tubular compartments 58 are identical in width. The tubular compartments prevent photocells numbered 1–15 from being falsely triggered by sunlight. Preferably, six outside photocells 60 are substantially the same size as the outside tubular compartment 54. Preferably, six inside photocells 62 are substantially the same size as the inside tubular compartment 56. Preferably, three center photocells 64 are substantially the same size as the center tubular compartment 58. The photocells are retained on a photocell board 46. The power source is preferably at least one battery 44. The at least one battery 44 powers the photocells and the on-off switch 52 controls electrical power supplied to the photocells.

Figure 7:
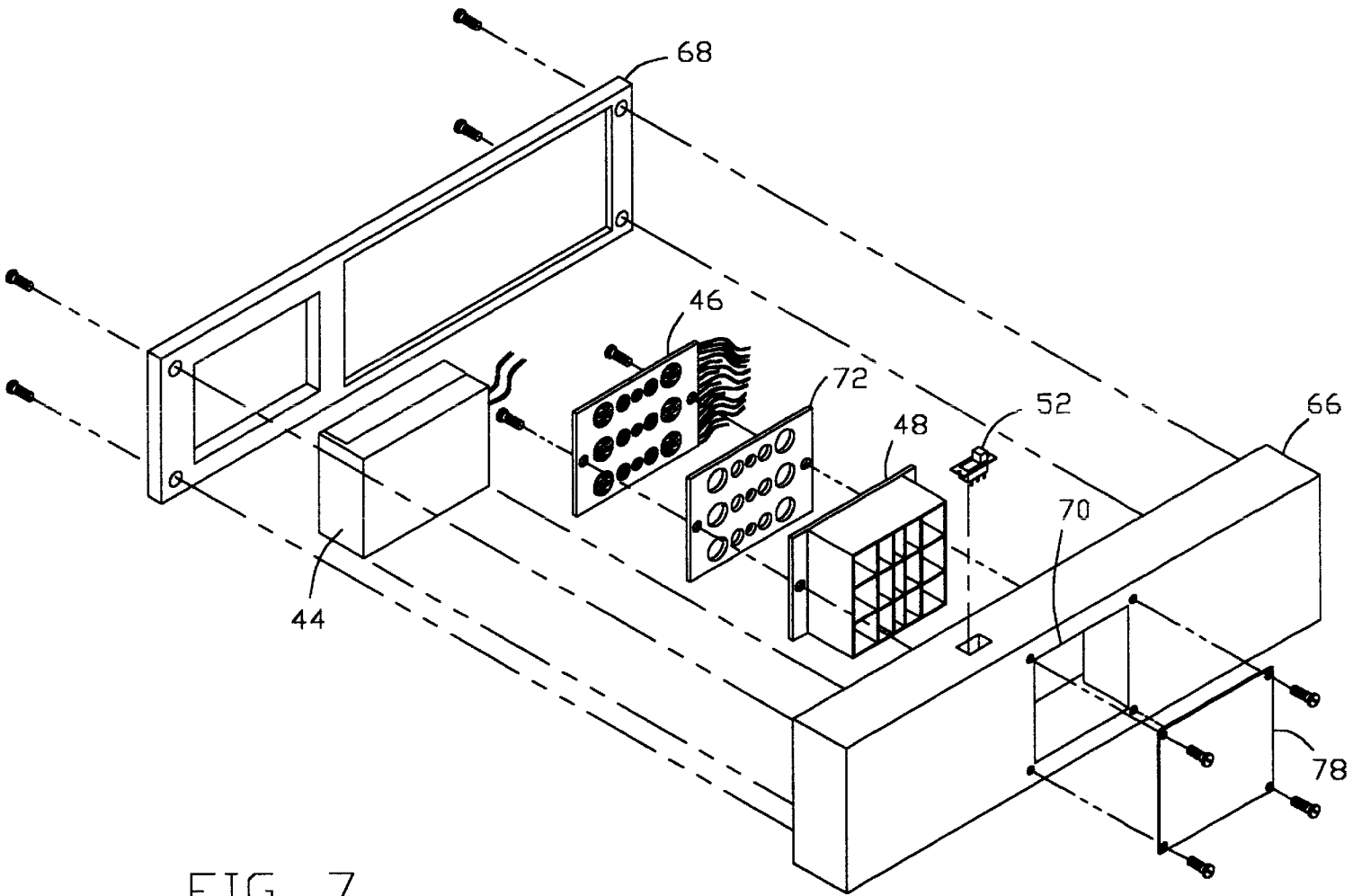
FIG. 7 is an exploded perspective view of a light sensing unit of a golf putting indication device in accordance with the present invention.
Figure 8:
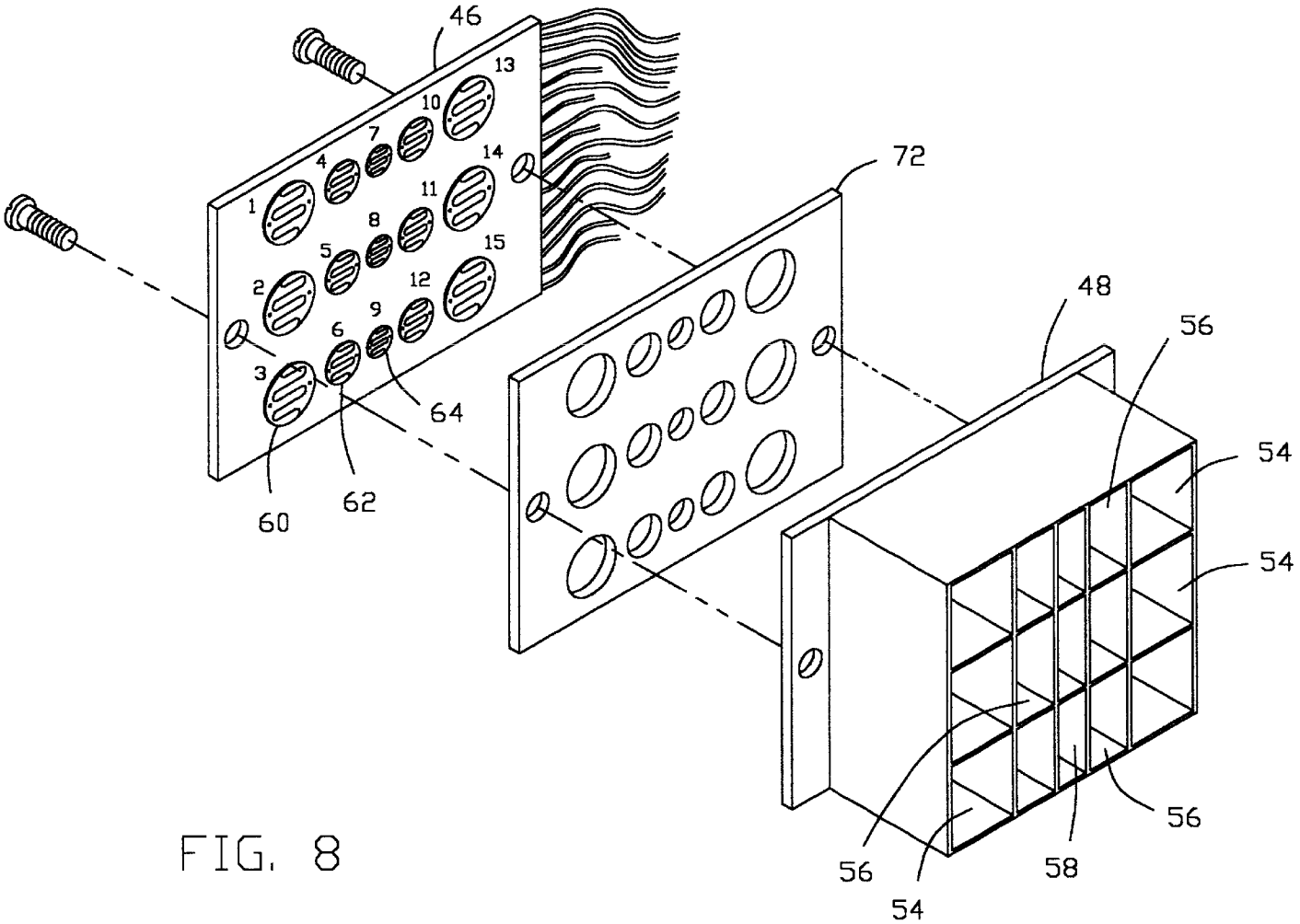
FIG. 8 is a perspective view of a photocell board, photocell spacer, and photocell housing of a golf putting indication device in accordance with the present invention.
Figure 10:
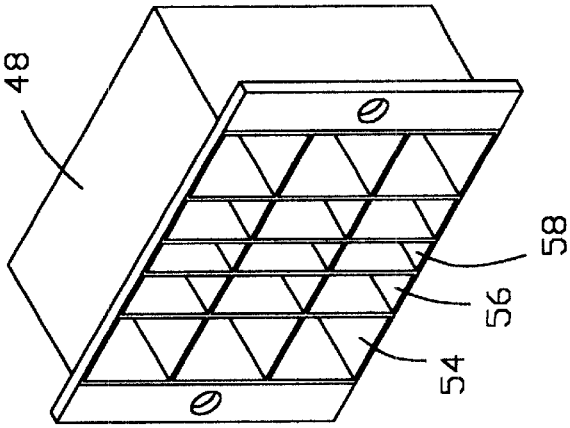
FIG. 10 is a rear perspective view of a photocell housing of a golf putting indication device in accordance with the present invention.
Figure 9:
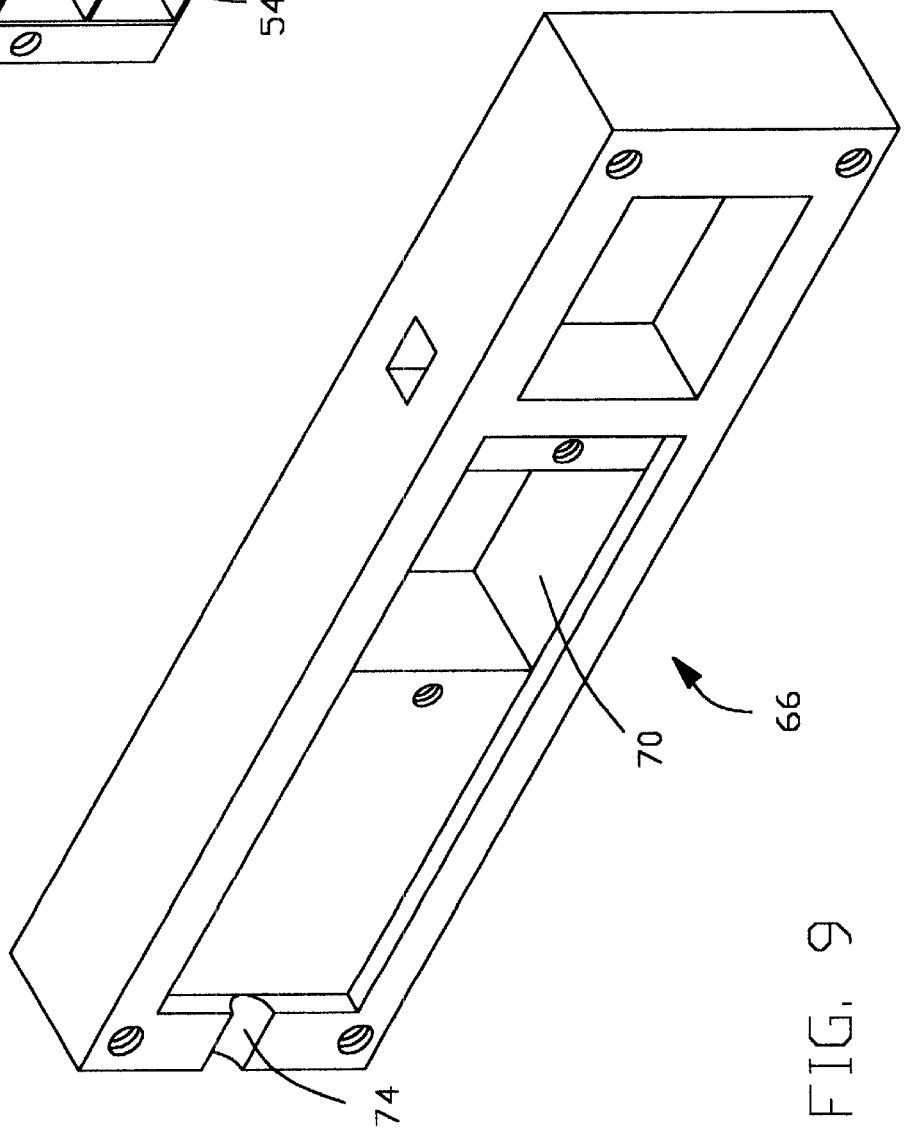
FIG. 9 is a rear perspective view of a front portion of a sense housing of a golf putting indication device in accordance with the present invention.

The sense housing 50 preferably includes a front portion 66 and a rear portion 68. The front portion 66 includes a photocell opening 70 which is sized to receive the photocell housing 48. The photocell board 46, a photocell spacer 72, and the photocell housing 48 are attached to a back of the front portion 66. The photocell spacer 72 prevents the photocell board 46 from being damaged when attached to the back of the front portion 66 with fasteners; other attachment methods may also be used besides fasteners such as gluing or sonic welding. A cable recess 74 is preferably formed in a side of the front portion 66 to provide clearance for a connection cable 76. The connection cable 76 contains the wires which connect the photocells to a plurality of light emitting devices 81 in the display unit 14. The at least one battery 44 is retained in the sense housing 50 when the front and rear portions are attached to each other. Fasteners are shown in FIG. 7 for attaching the front portion 66 to the rear portion 68, but other assembly methods may also be used such as gluing or sonic welding. A clear protective plate 78 is preferably attached to a front of the front portion 66 to keep foreign matter out of the plurality of tubular compartments in the photocell housing 48. FIG. 7 shows that fasteners are used to attached the clear protective plate 78, but other attachment methods may also be used such as gluing or sonic welding.

Figure 12:
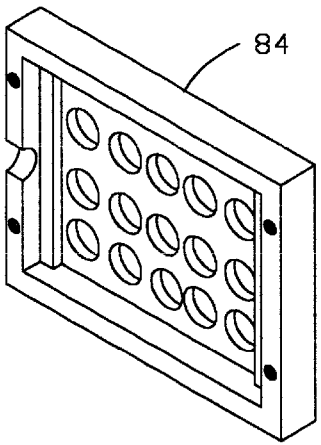
FIG. 12 is a rear perspective view of a cover plate of a display unit of a golf putting indication device in accordance with the present invention.
Figure 11:
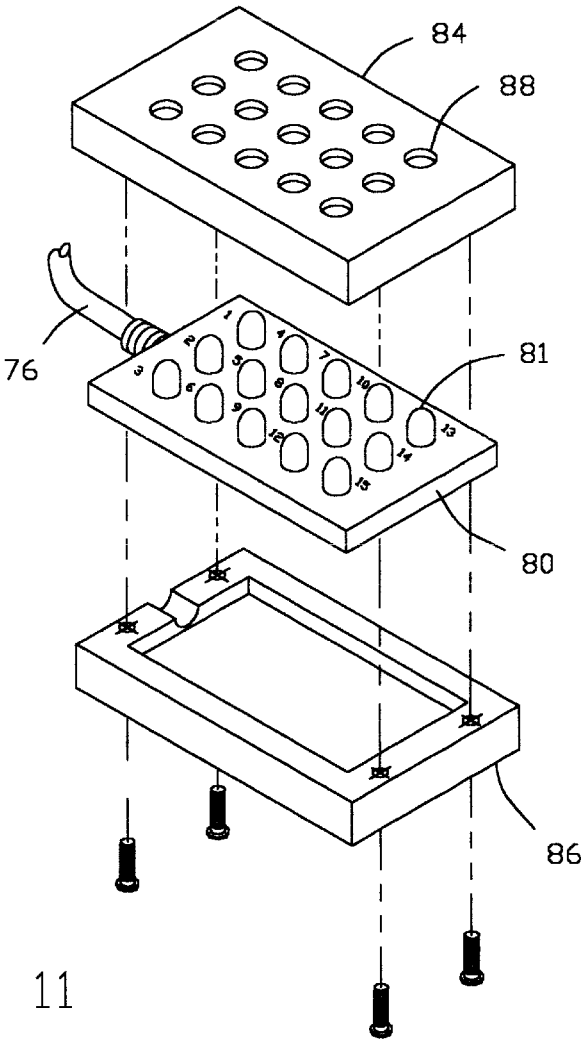
FIG. 11 is an exploded perspective view of a display unit of a golf putting indication device in accordance with the present invention.

With reference to FIGS. 11 and 12, the display unit 14 preferably includes a light emitting board 80 and a case 82. A plurality of light emitting devices 81 are retained by the light emitting board 80. Each light emitting device 81 is numbered from 1–15. The numbers on the light emitting board 80 adjacent the A plurality of light emitting devices 81 correspond to the numbers adjacent the plurality of photocells. Each light emitting device 16 is electrically connected to wires contained in the cable 76 to the plurality of photocells. The case 82 preferably includes a top portion 84 and a bottom portion 86. A plurality of light clearance openings 88 are formed through the top portion 84 to provide clearance for the plurality of light emitting devices 81. The bottom portion 86 is attached to the top portion 84 with the light emitting board 80 retained therebetween. FIG. 11 shows that fasteners are used to attach the bottom portion 86 to the top portion 84, but other attachment methods may also be used such as gluing or sonic welding. FIG. 13 discloses an electrical schematic of each light emitting device (LED) 81, on-off switch 52, at least one battery 44, and each photocell. When a photocell is struck with the light beam 102 from the light projecting device 16, the photocell's respective light emitting device 81 emits light.

The golf putting indication device 1 is preferably used in the following manner. The on-off switches on the light emitting golf putter 10 and the light sensing unit 12 are turned on. The golfer 100 aims the light beam 102 projecting from the strike face 26 at one of the tubular compartments. The golfer 100 practices swinging the light emitting golf putter 10 such that the light beam 102 only enters one of the tubular compartments. The golfer 100 knows which tubular compartment is being struck, because its respective light emitting device 81 will emit light. If the arc of the swing is to far, the light emitting device 81 of a tubular compartment above or below the targeted tubular compartment will emit light. If a light emitting device 81 from another column of tubular compartments emits light, the swing was not straight. When the golfer's swing improves they may choose a smaller width tubular compartment to practice their putter swing.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A golf putting indication device comprising:

a golf putter having a light beam projectable from a strike face thereof;

a light sensing unit having at least one tubular compartment, a single photocell being disposed at one end of each of said at least one tubular compartments;

a display unit having at least one light emitting device, a single said light emitting device being electrically connected to a single said photocell, said display unit being movable such that said at least one light emitting device is within the sight of a golfer; and a power source supplying at least one said photocell and said at least one light emitting device with electrical power, wherein when said light beam contacts one of said photocells, a single said light emitting device emitting light.

2. The golf putting indication device of claim 1, further comprising:

said golf putter having a shaft and a putter head, said shaft extending upward from said putter head, a strike face being formed on a front of said putter head, a light projecting device being retained in said putter head such that a light beam projects from said strike face, at least one battery supplying said light projecting device with electrical power, an on-off switch controlling the flow of electrical power to said light projecting device.

3. The golf putting indication device of claim 1, further comprising:

a clear protective plate being attached to a front of said at least one tubular compartment.

4. The golf putting indication device of claim 1, further comprising:

an on-off switch controlling the flow of electrical power to at least one said photocell, said at least one light emitting device and said power source.

5. The golf putting indication device of claim 4, further comprising:

a sense housing containing at least one said photocell, said at least one tubular compartment said power source, and said on-off switch.

6. The golf putting indication device of claim 1, further comprising:

said light sensing unit having at least three photocells and at least three tubular compartments, each of said at least three tubular compartments having a different width.

7. The golf putting indication device of claim 1, further comprising:

at least two tubular compartments being disposed one upon the other.

8. A golf putting indication device comprising:

a golf putter having a shaft extending from a putter head, a strike face formed on said putter head, a light projecting device being retained in said putter head such that a light beam is projectable from said strike face;

a light sensing unit having at least one tubular compartment, a single photocell being disposed at one end of each of said at least one tubular compartments;

a display unit having at least one light emitting device, a single said light emitting device being electrically connected to a single said photocell, said display unit being movable such that said at least one light emitting device is within the sight of a golfer;

a power source supplying at least one said photocell and said at least one light emitting device with electrical power, wherein when said light beam contacts one of said photocells, a single said light emitting device emitting light; and at least two tubular compartments being disposed one upon the other.

9. The golf putting indication device of claim 8, further comprising:

at least one battery supplying said light projecting device with electrical power, an on-off switch controlling the flow of electrical power to said light projecting device.

10. The golf putting indication device of claim 8, further comprising:

a clear protective plate being attached to a front of said at least one tubular compartment.

11. The golf putting indication device of claim 8, further comprising:

an on-off switch controlling the flow of electrical power to at least one said photocell, said at least one light emitting device and said power source.

12. The golf putting indication device of claim 11, further comprising:

a sense housing containing at least one said photocell, said at least one tubular compartment said power source, and said on-off switch.

13. The golf putting indication device of claim 8, further comprising:

said light sensing unit having at least three photocells and at least three tubular compartments, each of at least three tubular compartments having a different width.

14. A golf putting indication device comprising:

a golf putter having a shaft extending from a putter head, a strike face formed on said putter head, a light projecting device being retained in said putter head such that a light beam is projectable from said strike face;

a light sensing unit having at least two tubular compartments, a single photocell being disposed at one end of each one of said at least two tubular compartments, each one of said at least two tubular compartments having-a different width;

a display unit having at least two light emitting devices, a single said light emitting device being electrically connected to a single said photocell, said display unit being movable such that said at least two light emitting device is within the sight of a golfer; and a power source supplying at least two said photocells and said at least two light emitting device with electrical power, wherein when said light beam contacts one of said photocells, a single said light emitting device emitting light.

15. The golf putting indication device of claim 14, further comprising:

at least one battery supplying said light projecting device with electrical power, an on-off switch controlling the flow of electrical power to said light projecting device.

16. The golf putting indication device of claim 14, further comprising:

a clear protective plate being attached to a front of said at least one tubular compartment.

17. The golf putting indication device of claim 14, further comprising:

an on-off switch controlling the flow of electrical power to at least one said photocell, said at least one light emitting device and said power source.

18. The golf putting indication device of claim 17, further comprising:

a sense housing containing at least one said photocell, said at least one tubular compartment said power source, and said on-off switch.

19. The golf putting indication device of claim 14, further comprising:

at least two tubular compartments being disposed one upon the other.

* * * * *